US010285491B2

(12) United States Patent
Xing

(10) Patent No.: US 10,285,491 B2
(45) Date of Patent: May 14, 2019

(54) BAG CARRIER FOR HAND

(71) Applicant: Haoyu Xing, Shenzhen (CN)

(72) Inventor: Haoyu Xing, Shenzhen (CN)

( * ) Notice: Subject to any disclaimer, the term of this patent is extended or adjusted under 35 U.S.C. 154(b) by 0 days.

(21) Appl. No.: 16/065,133

(22) PCT Filed: Jan. 13, 2016

(86) PCT No.: PCT/CN2016/070754
§ 371 (c)(1),
(2) Date: Jun. 22, 2018

(87) PCT Pub. No.: WO2017/120779
PCT Pub. Date: Jul. 20, 2017

(65) Prior Publication Data
US 2018/0360200 A1 Dec. 20, 2018

(51) Int. Cl.
*A45F 5/00* (2006.01)
*A45F 5/10* (2006.01)

(52) U.S. Cl.
CPC ..... *A45F 5/1046* (2013.01); *A45F 5/10* (2013.01)

(58) Field of Classification Search
CPC ..... A45F 5/10; A45F 5/1046
USPC ..... 294/137, 165, 171; 361/694.56
See application file for complete search history.

(56) References Cited

U.S. PATENT DOCUMENTS 4,279,366 A 7/1981 Kessler et al.

FOREIGN PATENT DOCUMENTS

| | | | |
|---|---|---|---|
| CA | 2062336 | A1 | 8/1993 |
| CN | 101474015 | A | 7/2009 |
| CN | 203435869 | U | 2/2014 |
| CN | 104643542 | A | 5/2015 |
| CN | 105029885 | A | 11/2015 |
| CN | 204908404 | U | 12/2015 |
| CN | 105411181 | A | 3/2016 |
| CN | 205456923 | U | 8/2016 |
| KR | 20-2011-0009664 | U | 10/2011 |

OTHER PUBLICATIONS

Xianglei Zhang. the International Searching Authority written comments, dated Sep. 2016, CN.
Xianglei Zhang, the International Search Report, dated Sep. 2016, CN.

*Primary Examiner* — Paul T Chin

(57) ABSTRACT

The present disclosure provides a bag carrier for hand, including a handle, a fastener and a button. The handle includes a handheld portion and a bag carrying portion. The handle is provided with an opening between the handheld portion and the bag carrying portion. The fastener includes a closing portion for closing the opening. A passage for placing the button is disposed at the end of the handheld portion. The button is movably placed in the passage and is fixedly connected to the first elastic rod. The button is pressed to drive the first elastic rod to deform so as to open the closing portion.

18 Claims, 5 Drawing Sheets

BAG CARRIER FOR HAND

TECHNICAL FIELD

The present disclosure relates to the field of daily household goods, and more particularly to a bag carrier for hand.

BACKGROUND

In daily life, people often carry articles with hands. In particular, with the improvement of the consumption level, people go to the supermarket for shopping more and more frequently and buy more kinds of vegetables in the vegetable market. It is hard to hold bags of different sizes with hands. Most people feel pain in fingers if they have heavy articles in hands for a longer time. Sometimes, the mouth of the bag is soiled by the vegetables when the vegetables are loaded in the bags. It is not comfortable to hold the bags in the hands, and it is inconvenient for the soiled hands to work.

SUMMARY

A technical problem to be solved by the present disclosure is to provide a bag carrier for hand for convenience of carrying vegetables or articles.

The purpose of the present disclosure is realized by the following technical solution: The present disclosure discloses a bag carrier for hand, comprising:

a handle adopting an annular structure, comprising a handheld portion and a bag carrying portion opposite to the handheld portion and provided with an opening between the handheld portion and the bag carrying portion;

a fastener comprising a closing portion for closing the opening and provided with a first pin shaft hole, wherein the handheld portion is provided with a first pin shaft to be inserted into the first pin shaft hole; the fastener also comprises a first elastic rod disposed in the handheld portion; the handheld portion is provided with a stop element for stopping the first elastic rod; and the first pin shaft hole is located between the first elastic rod and the closing portion; and a button, wherein a passage for placing the button is disposed at the end of the handheld portion; the button is movably placed in the passage and is fixedly connected to the first elastic rod; and the button is pressed to drive the first elastic rod to deform so as to open the closing portion.

Preferably, a groove is formed at one end of the opening and located at the end of the bag carrying portion. A first clip is arranged at an edge of one side of the groove. Correspondingly, a second clip protruded outwards and clamped and matched with the first clip is arranged at the end of the closing portion. When the closing portion closes to the position of the opening, the second clip is placed in the groove and the second clip is buckled with the first clip. In this way, the whole handle forms an annular structure. When the articles are carried, the handle is stressed uniformly.

Preferably, the fastener is provided with a second pin shaft hole in the first elastic rod. The button is provided with a second pin shaft to be inserted into the second pin shaft hole. This is a specific manner of fixed connection of the button and the fastener. Thus, when the button is pressed, the button moves in the passage of the handheld portion and the second pin shaft of the button presses the side wall around the second pin shaft hole. Thus, the first elastic rod is stressed and deformed so that the closing portion located at one side of the first pin shaft hole is deformed outwards, so as to open the opening.

Preferably, the fastener is provided with a second elastic rod protruded outwards around the second pin shaft hole and presenting a bent bow structure, and the button is provided with a bottom platform in abutting fit with the second elastic rod. The second elastic rod is mutually matched with the bottom platform of the button. During pressing, not only the first elastic rod is driven by the second pin shaft, but also the first elastic rod is driven by the second elastic rod, so as to avoid damaging the first elastic rod easily due to drive of the first elastic rod by a single point.

Preferably, the stop element comprises a stop column and a stop plate. The end of the first elastic rod is located between the stop column and the stop plate. The end of the first elastic rod is protruded towards a direction matched with the stop plate, and is inwards concave towards a direction matched with the stop column. The stop column and the button are located at the same side of the first elastic rod. This is a specific manner for stopping the first elastic rod. When the button is pressed and an acting force is applied to the first elastic rod through the button, the middle of the first elastic rod is deformed downwards. At this moment, because the edge of the stressed first elastic rod is contracted towards the middle, the end of the first elastic rod then moves along the stop column and the stop plate. The first elastic rod configured into a downward bending structure so that the first elastic rod is suitable for the structure of the stop column. Thus, the end of the first elastic rod is always located between the stop column and the stop plate to prevent the end of the first elastic rod from separating from a position between the stop plate and the stop column.

Preferably, an external surface of the button is provided with a plurality of raised lines of bar-shaped structures. The raised lines have a nonskid effect, for the convenience of a user to press with a thumb.

Preferably, a middle of the external surface of the button is provided with a recess. The recess is disposed in the middle of the external surface of the button so that the external surface of the button is suitable for placing the thumb, for the convenience of the user to press the button.

Preferably, the bag carrier for hand also comprises an elastic gasket disposed on an external surface of the handheld portion. The elastic gasket is disposed for the convenience of the user to hold, enhancing the comfort of holding for the user.

Preferably, the handheld portion is provided with a finger groove for placing a finger. The finger groove is disposed for the convenience of the user to hold, enhancing the comfort of holding for the user.

Preferably, the bag carrying portion is in a semicircular structure. This is a specific structure of the bag carrying portion for the convenience of placing a suspender.

Compared with the prior art, the present disclosure has the technical effects: the opening is disposed in the handle between the handheld portion and the bag carrying portion so that the articles to be carried are placed in the handle through the position of the opening and suspended on the bag carrying portion. The user holds the handheld portion to achieve the convenience of carrying for the user. In the bag carrier for hand of the present disclosure, the fastener and the button for controlling the fastener are also disposed in the position of the opening. The button is installed and fixed in the passage at the end of the handheld portion. In the use process, the user holds the handheld portion with hands and places the thumb on the button. The thumb presses the button. The button is stressed to move along the passage and drive the first elastic rod. The first elastic rod is stressed to deform along the pressing direction. Because of the principle of action of force, both end portions of the first elastic rod move towards the direction opposite to the pressing direction. Thus, the closing portion located at one end of the first elastic rod is gradually separated from the position of the opening to open the opening. The other end of the first elastic rod is stopped by the stop element, thereby guaranteeing that the first elastic rod, when stressed and deformed, can drive the closing portion to move along with the first elastic rod. In the present disclosure, the button is pressed to drive the fastener so as to open the closing portion of the fastener used for closing the opening. Thus, after the articles are suspended on the bag carrying portion, the closing portion closes the opening to prevent the articles from dropping out. When the articles are taken off, because the button is installed and fixed at the end of the handheld portion, the user holds the handheld portion with hands and places the thumb in the position of the button so as to press the button through a single hand to open the closing portion for the convenience of taking off the articles located at the bag carrying portion. The present disclosure drives the closing portion of the fastener through the button disposed at the end of the handheld portion in order to control the closing portion to close and open the opening. Thus, it is convenient for the user to suspend the articles on the bag carrying portion or take off the articles from the bag carrying portion.

In the figures: 100 bag carrier for hand; 110 handle; 111 opening; 112 passage; 113 first pin shaft; 114 stop column; 115 stop plate; 116 placing groove; 117 first clip; 118 finger groove; 120 fastener; 121 closing portion; 122 first pin shaft hole; 123 first elastic rod; 124 second pin shaft hole; 125 second elastic rod; 126 second clip; 127 second lightening hole; 130 button; 131 second pin shaft; 132 moving plate; 133 raised line; 134 first lightening hole; 140 elastic gasket; 150 handheld portion; and 160 bag carrying portion.

DETAILED DESCRIPTION

The present disclosure will be further described in detail below in combination with the drawings and preferred embodiments.

It should be understood in the description of the present disclosure that terms such as "central", "horizontal", "upper", "lower", "left", "right", "vertical", "horizontal", "top", "bottom", "inner", "outer", etc. indicate direction or position relationships shown based on the drawings, and are only intended to facilitate the description of the present disclosure and the simplification of the description rather than to indicate or imply that the indicated device or element must have a specific direction or constructed and operated in a specific direction, and therefore, shall not be understood as a limitation to the present disclosure. In addition, the terms such as "first" and "second" are only used for the purpose of description, rather than being understood to indicate or imply relative importance or hint the number of indicated technical features. Thus, the feature limited by "first" and "second" can explicitly or impliedly include one or more features. In the description of the present disclosure, the meaning of "a plurality of" is two or more unless otherwise specified. In addition, the term "comprise" and any variant are intended to cover non-exclusive inclusion.

It should be noted in the description of the present disclosure that, unless otherwise specifically regulated and defined, terms such as "installation," "connected," and "connecting" shall be understood in broad sense, and for example, may refer to fixed connection or detachable connection or integral connection, may refer to mechanical connection or electrical connection, and may refer to direct connection or indirect connection through an intermediate medium or inner communication of two elements. For those of ordinary skill in the art, the meanings of the above terms in the present disclosure may be understood according to concrete conditions.

The bag carrier for hand of the embodiment of the present disclosure is described below with reference to FIG. 1 to FIG. 6.

The purpose of the present disclosure is realized by the following technical solution: The present disclosure discloses a bag carrier for hand 100, comprising: a handle 110, a fastener 120 and a button 130.

Figure 2:
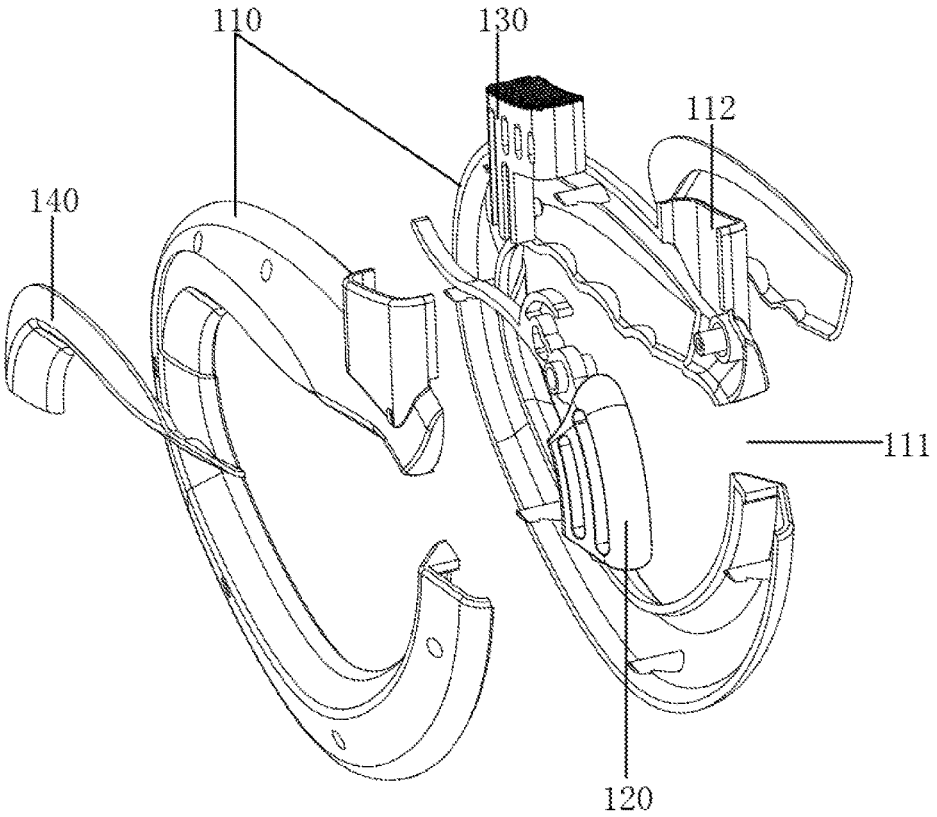
FIG. 2 is a split schematic diagram of a bag carrier for hand of embodiments of the present disclosure.

The handle 110 adopts an annular structure. The handle 110 comprises a handheld portion 150 and a bag carrying portion 160 opposite to the handheld portion 150. The handle 110 is provided with an opening 111 between the handheld portion 150 and the bag carrying portion 160, as shown in FIG. 2. Specifically, the handle of the annular structure is convenient for the user to hold. During use, the user holds the handheld portion 150 with hand and suspends the articles (such as vegetables) to be carried from the position of the opening 111 to the bag carrying portion 160. The handheld portion and the bag carrying portion of the present disclosure are opposite, so as to achieve the convenience of carrying the articles through the bag carrier for hand for the user.

Figure 1:
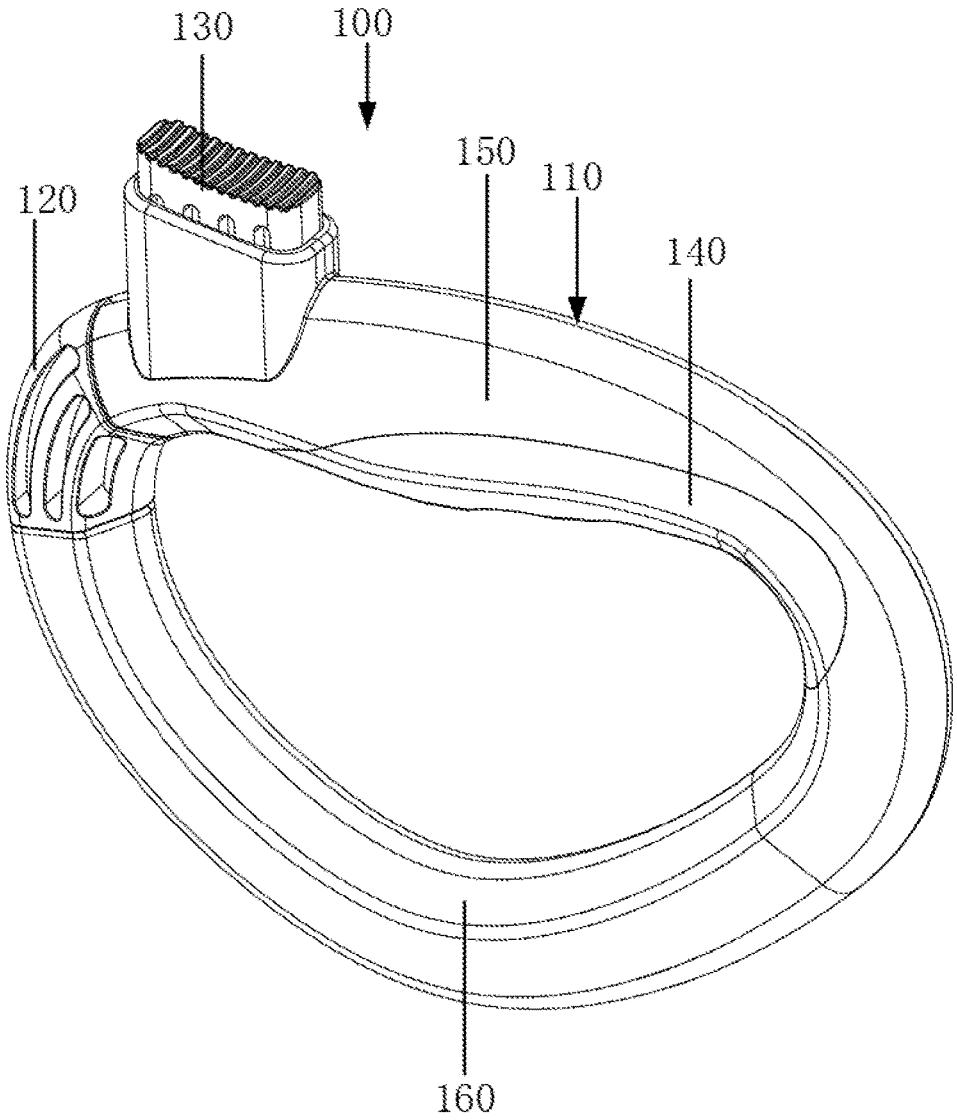
FIG. 1 is an integral structural schematic diagram of a bag carrier for hand of embodiments of the present disclosure.
Figure 3:
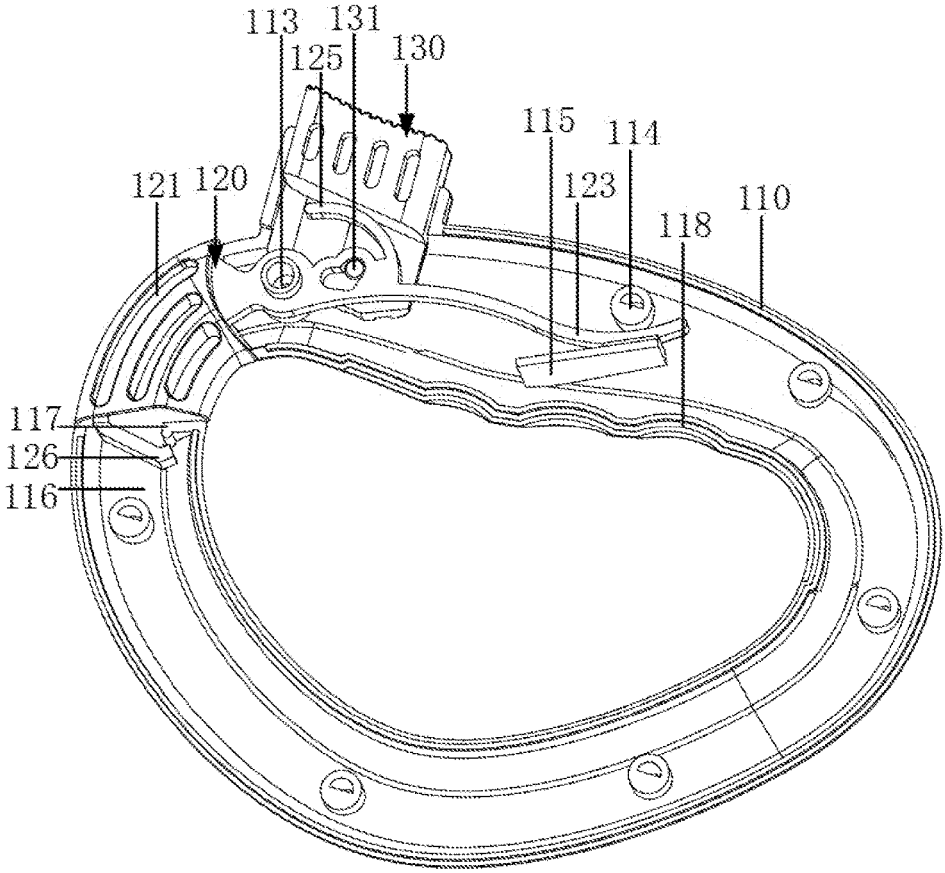
FIG. 3 is a schematic diagram of matching of a button, a fastener and a handle of embodiments of the present disclosure.
Figure 4:
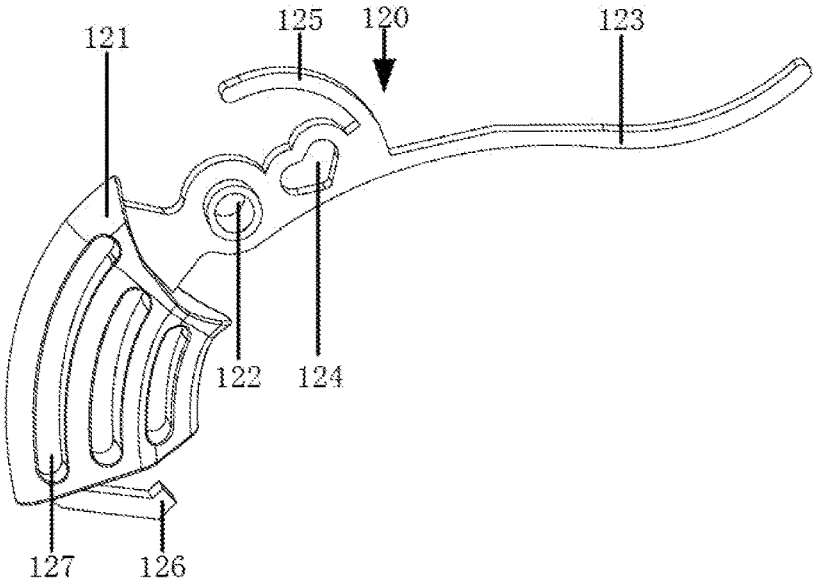
FIG. 4 is a structural schematic diagram of a fastener of embodiments of the present disclosure.

As shown in FIG. 4, a structural schematic diagram of the fastener is given. The fastener 120 comprises a closing onion portion 121 for closing the opening 111. With reference to FIG. 1, the closing portion 121 is located in the position of the opening 111, is suitable for the size of the opening 111 and is used to close the opening 111. The fastener 120 is provided with a first pin shaft hole 122. The handheld portion 150 is provided with a first pin shaft 113 to be inserted into the first pin shaft hole 122. As shown in FIG. 3, a schematic diagram of matching of the fastener 120, the button 130 and the handle 110 is given, which is specifically a schematic diagram that the fastener and the button are placed on part of the handle. In the present embodiment, the handle comprises a left handle and a right handle. Herein, the fastener and the button are placed on the right handle. The fastener 120 also comprises a first elastic rod 123 disposed in the handheld portion 150. The first pin shaft hole 122 is located between the first elastic rod 123 and the closing portion 121. The handheld portion 150 is provided with a stop element for stopping the first elastic rod 123. The stop element has an action of stopping and fixing the first elastic rod to prevent the first elastic rod from separating.

As shown in FIG. 2, a passage 112 for placing the button 130 is disposed at the end of the handheld portion 150. As shown in FIG. 3, the button 130 is movably placed in the passage 112 and is fixedly connected to the first elastic rod 123. The button 130 is pressed to drive the first elastic rod 123 to deform so as to open the closing portion.

Specifically, the opening 111 is disposed in the handle 110 between the handheld portion 150 and the bag carrying portion 160 so that the articles to be carried are placed in the handle 110 through the position of the opening 111 and suspended on the bag carrying portion 160. The user holds the handheld portion 150 to achieve the convenience of carrying for the user. In the bag carrier for hand 100 of the present disclosure, the fastener 120 and the button 130 for controlling the fastener 120 are also disposed in the position of the opening 111. The button 130 is installed and fixed in the passage 112 at the end of the handheld portion 150. In the use process, the user holds the handheld portion 150 with hands and places the thumb on the button 130. The thumb presses the button 130. The button 130 is stressed to move along the passage 112 and drive the first elastic rod 123. The first elastic rod 123 is stressed to deform along the pressing direction. Because of the principle of action of force, both end portions of the first elastic rod 123 move towards the direction opposite to the pressing direction. Thus, the closing portion 121 located at one end of the first elastic rod 123 is gradually separated from the position of the opening 111 to open the opening 111. The other end of the first elastic rod 123 is stopped by the stop element and is not separated, thereby guaranteeing that the first elastic rod 123, when stressed and deformed, can drive the closing portion 121 to move along with the first elastic rod 123. In the present disclosure, the button 130 is pressed to drive the fastener 120 so as to open the closing portion 121 of the fastener 120 used for closing the opening 111. Thus, after the articles are suspended on the bag carrying portion 160, the closing portion 121 closes the opening 111 to prevent the articles from dropping out. When the articles are taken off, because the button 130 is installed and fixed at the end of the handheld portion 150, the user holds the handheld portion 150 with hands and places the thumb in the position of the button 130 so as to press the button 130 through a single hand to open the closing portion 121 for the convenience of taking off the articles located at the bag carrying portion 160. The present disclosure drives the closing portion 121 of the fastener 120 through the button 130 disposed at the end of the handheld portion 150 in order to control the closing portion 121 to close and open the opening 111. Thus, it is convenient for the user to suspend the articles on the bag carrying portion 160 or take off the articles from the bag carrying portion 160.

The handheld portion 150 is provided with a stop element for stopping the first elastic rod 123. The stop element comprises a stop column 114 and a stop plate 115. The end of the first elastic rod 123 is located between the stop column 114 and the stop plate 115. The end of the first elastic rod 123 is protruded towards a direction matched with the stop plate 115, and is inwards concave towards a direction matched with the stop column 114. The stop column 114 and the button 130 are located at the same side of the first elastic rod 123. This is a specific manner for stopping the first elastic rod. Specifically, when the button 130 is pressed and an acting force is applied to the first elastic rod 123 through the button 130, the middle of the first elastic rod 123 is deformed downwards. At this moment, because the edge of the stressed first elastic rod 123 is contracted towards the middle, the end of the first elastic rod 123 then moves along the stop column 114 and the stop plate 115. The first elastic rod 123 is configured into a downward bending structure so that the first elastic rod 123 is suitable for the structure of the stop column 114. Thus, the end of the first elastic rod 123 is always located between the stop column 114 and the stop plate 115 to prevent the end of the first elastic rod 123 from separating from a position between the stop plate 115 and the stop column 114.

The fastener 120 is provided with a second pin shaft hole 124 in the first elastic rod 123. The button 130 is provided with a second pin shaft 131 to be inserted into the second pin shaft hole 124. This is a specific manner of fixed connection of the button 130 and the fastener 120. Thus, when the button 130 is pressed, the button 130 moves in the passage 112 of the handheld portion 150 and the second pin shaft of the button 130 presses the side wall around the second pin shaft hole. Thus, the first elastic rod 123 is stressed and deformed so that the closing portion 121 located at one side of the first pin shaft hole 122 is deformed outwards, so as to open the opening 111.

Specifically, the button 130 is provided with a moving plate 132 extending towards the bottom. When the button 130 is placed in the passage 112, the moving plate 132 is tightly close to a side wall in the passage 112 and can move up and down along the side wall. The first pin shaft 131 is disposed at the end position of the moving plate 132. Thus, when the button 130 moves in the passage, the moving plate 132 moves together, so as to drive the second pin shaft 131 to move in order to enable the second pin shaft 131 to drive the first elastic rod 123 to deform, thereby opening or closing the opening 111 by the closing portion.

Further, as shown in FIG. 3 and FIG. 4, the fastener 120 is provided with a second elastic rod 125 protruded outwards around the second pin shaft hole 124 and presenting a bent how structure, and the button 130 is provided with a bottom platform in abutting fit with the second elastic rod 125, i.e., the bottom of the button 130 is abutted against the second elastic rod 125. The second elastic rod 125 is mutually matched with the bottom platform of the button. When the button 130 is pressed, not only the first elastic rod 123 is driven by the second pin shaft 131, but also the first elastic rod 123 is driven by the second elastic rod 125, so as to avoid damaging the first elastic rod 123 easily due to drive of the first elastic rod 123 by a single point.

Figure 5:
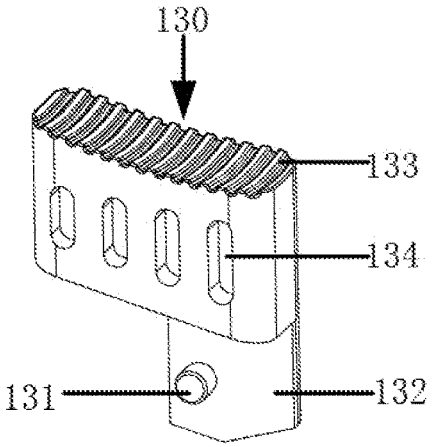
FIG. 5 is a structural schematic diagram of a button of embodiments of the present disclosure.
Figure 6:
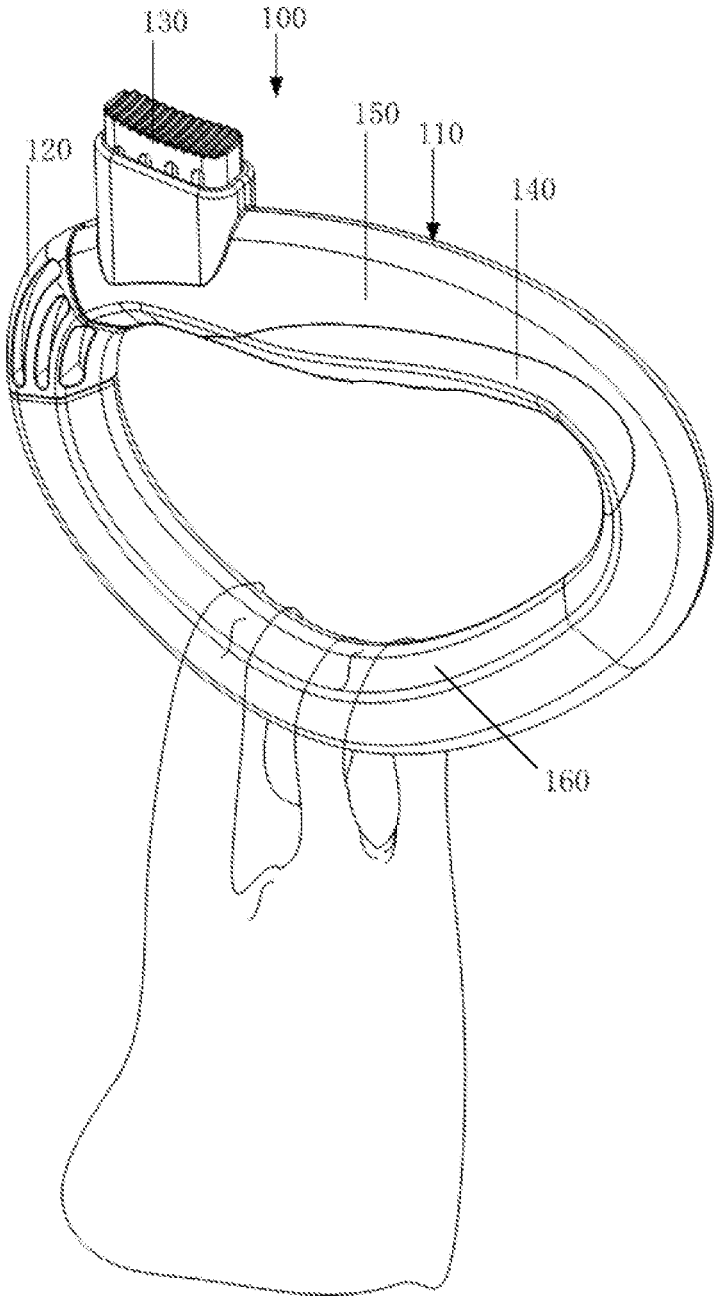
FIG. 6 is an usage schematic diagram of a bag carrier for hand of embodiments of the present disclosure.

As shown in FIG. 5, an external surface of the button 130 is provided with a plurality of raised lines 133 of bar-shaped structures. The raised lines 130 have a nonskid effect, for the convenience of a user to press with a thumb.

A middle of the external surface of the button 130 is provided with a downward recess. The middle of the external surface of the button 130 is provided with the recess so that the external surface of the button 130 is suitable for placing the thumb for the convenience of the user to press the button 130.

As shown in FIG. 1 and FIG. 2, the bag carrier for hand 100 also comprises an elastic gasket 140 disposed on an external surface of the handheld portion 150. The elastic gasket 140 is elastic and soft, and is disposed for the convenience of the user to hold, enhancing the comfort of holding for the user.

As shown in FIG. 3, the handheld portion 159 is provided with a finger groove 118 for placing a finger. The finger groove is disposed for the convenience of the user to hold, enhancing the comfort of holding the user.

In the present embodiment, the bag carrying portion 160 is in a semicircular structure. This is a specific structure of the bag carrying portion 160 for the convenience of placing a suspender. Of course, the bag carrying portion can also be configured into other structures.

In the present embodiment, a plurality of first lightening holes 134 disposed at intervals are formed in the button 130, and the first lightening holes have the action of weight reduction. In the present embodiment, a plurality of second lightening holes 127 disposed at intervals are formed in the closing portion 121 of the fastener 120, and the second lightening holes also have the action of weight reduction.

As a preferred solution of the present embodiment, a groove 116 is formed at one end of the opening 111 and located at the end of the bag carrying portion 160. As shown in FIG. 3, a first clip 117 is disposed at an edge of one side of the groove 116. Correspondingly, a second clip 126 protruded outwards and clamped and matched with the first clip 117 is disposed at the end of the closing portion 121. When the closing portion 121 closes to the position of the opening 111, the second clip 126 is placed in the groove 116 and the second clip 126 is buckled with the first clip 117. In this way, the whole handle 110 forms an annular structure. When the articles are carried, the handle 110 is stressed uniformly.

The above contents are further detailed descriptions of the present disclosure in combination with specific preferred embodiments. However, the specific implementation of the present disclosure shall not be considered to be only limited to these descriptions. For those ordinary skilled in the art to which the present disclosure belongs, several simple deductions or replacements may be made without departing from the conception of the present disclosure, all of which shall be considered to belong to the protection scope of the present disclosure.

The invention claimed is:

1. A bag carrier for hand, comprising:

a handle adopting an annular structure, comprising a handheld portion and a bag carrying portion opposite to the handheld portion and provided with an opening between the handheld portion and the bag carrying portion;

a fastener comprising a closing portion for closing the opening and provided with a first pin shaft hole, wherein the handheld portion is provided with a first pin shaft to be inserted into the first pin shaft hole; the fastener also comprises a first elastic rod disposed in the handheld portion; the handheld portion is provided with a stop element for stopping the first elastic rod; and the first pin shaft hole is located between the first elastic rod and the closing portion; and a button, wherein a passage for placing the button is disposed at the end of the handheld portion; the button is movably placed in the passage and is fixedly connected to the first elastic rod; and the button is pressed to drive the first elastic rod to deform so as to open the closing portion.

2. The bag carrier for hand according to claim 1, wherein a groove is formed at one end of the opening and located at the end of the bag carrying portion; a first clip is disposed at an edge of one side of the groove; and correspondingly, a second clip protruded outwards and clamped and matched with the first clip is disposed at the end of the closing portion.

3. The bag carrier for hand according to claim 2, wherein the fastener is provided with a second pin shaft hole in the first elastic rod; and the button is provided with a second pin shaft to be inserted into the second pin shaft hole.

4. The bag carrier for hand according to claim 2, wherein the stop element comprises a stop column and a stop plate; the end of the first elastic rod is located between the stop column and the stop plate; the end of the first elastic rod is protruded towards a direction matched with the stop plate, and is inwards concave towards a direction matched with the stop column; and the stop column and the button are located at the same side of the first elastic rod.

5. The bag carrier for hand according to claim 2, wherein an external surface of the button is provided with a plurality of raised lines of bar-shaped structures.

6. The bag carrier for hand according to claim 5, wherein the fastener is provided with a second elastic rod protruded outwards around the second pin shaft hole and presenting a bent bow structure; and the button is provided with a bottom platform in abutting fit with the second elastic rod.

7. The bag carrier for hand according to claim 2, wherein a middle of the external surface of the button is provided with a recess.

8. The bag carrier for hand according to claim 2, wherein the bag carrier for hand also comprises an elastic gasket disposed on an external surface of the handheld portion.

9. The bag carrier for hand according to claim 2, wherein the handheld portion is provided with a finger groove for placing a finger.

10. The bag carrier for hand according to claim 2, wherein the bag carrying portion is in a semicircular structure.

11. The bag carrier for hand according to claim 1, wherein the fastener is provided with a second pin shaft hole in the first elastic rod; and the button is provided with a second pin shaft to be inserted into the second pin shaft hole.

12. The bag carrier for hand according to claim 11, wherein the fastener is provided with a second elastic rod protruded outwards around the second pin shaft hole and presenting a bent bow structure; and the button is provided with a bottom platform in abutting fit with the second elastic rod.

13. The bag carrier for hand according to claim 1, wherein the stop element comprises a stop column and a stop plate; the end of the first elastic rod is located between the stop column and the stop plate; the end of the first elastic rod is protruded towards a direction matched with the stop plate, and is inwards concave towards a direction matched with the stop column; and the stop column and the button are located at the same side of the first elastic rod.

14. The bag carrier for hand according to claim 1, wherein an external surface of the button is provided with a plurality of raised lines of bar-shaped structures.

15. The bag carrier for hand according to claim 1, wherein a middle of the external surface of the button is provided with a recess.

16. The bag carrier for hand according to claim 1, wherein the bag carrier for hand also comprises an elastic gasket disposed on an external surface of the handheld portion.

17. The bag carrier for hand according to claim 1, wherein the handheld portion is provided with a finger groove for placing a finger.

18. The bag carrier for hand according to claim 1, wherein the bag carrying portion is in a semicircular structure.

* * * * *